US010687571B2

(12) United States Patent
Luna

(10) Patent No.: US 10,687,571 B2
(45) Date of Patent: Jun. 23, 2020

(54) CONVERTIBLE JACKET

(71) Applicant: Adiff, LLC, Brooklyn, NY (US)

(72) Inventor: Angela Luna, Brooklyn, NY (US)

(73) Assignee: ADIFF, LLC, Brooklyn, NY (US)

( * ) Notice: Subject to any disclaimer, the term of this patent is extended or adjusted under 35 U.S.C. 154(b) by 147 days.

(21) Appl. No.: 15/685,281

(22) Filed: Aug. 24, 2017

(65) Prior Publication Data

US 2018/0242663 A1 Aug. 30, 2018

Related U.S. Application Data

(63) Continuation of application No. 15/443,472, filed on Feb. 27, 2017.

(51) Int. Cl.

| | |
|---|---|
| ***A41D 15/00*** | (2006.01) |
| ***A41D 15/04*** | (2006.01) |
| ***E04H 15/30*** | (2006.01) |
| ***A45F 3/00*** | (2006.01) |
| ***A45F 4/14*** | (2006.01) |

(52) U.S. Cl.

CPC ..... *A41D 15/04* (2013.01); *A45F 3/00* (2013.01); *A45F 4/14* (2013.01); *E04H 15/30* (2013.01)

(58) Field of Classification Search

CPC ..... A41D 15/04; E04H 15/30; A45F 3/00

See application file for complete search history.

(56) References Cited

U.S. PATENT DOCUMENTS

| | | | | |
|---|---|---|---|---|
| 1,078,992 | A * | 11/1913 | Bryan | A41D 15/04 2/89 |
| 1,155,800 | A * | 10/1915 | Corbet | A41D 15/04 2/89 |
| 3,837,006 | A | 9/1974 | Laseman | |
| 4,180,867 | A | 1/1980 | Ridgeway, Jr. | |
| 4,594,735 | A | 6/1986 | Rolf et al. | |
| 4,766,918 | A * | 8/1988 | Odekirk | E04H 15/02 114/345 |
| 5,277,349 | A * | 1/1994 | Rowe | A45F 4/04 135/96 |

(Continued)

FOREIGN PATENT DOCUMENTS

| | | |
|---|---|---|
| CH | 347313 A | 6/1960 |
| EP | 026151 A1 | 4/1981 |

(Continued)

OTHER PUBLICATIONS

Office Action dated Sep. 14, 2018, issued in connection with U.S. Appl. No. 15/443,472 (10 pages).

(Continued)

*Primary Examiner* — Khaled Annis

(57) ABSTRACT

The present disclosure relates to a convertible jacket and, in particular, to a convertible jacket that is convertible between a wearable configuration to a tent configuration. The convertible jacket can include a body having one or more panels, sleeves attached to the body about sleeve openings, an inflatable air channel for providing a frame for the convertible jacket in a tent configuration, a fastening means for securing the air channel to the body, a base, and a means for securing the base to a bottom edge of the body. Methods are also provided for converting the convertible jacket from a wearable configuration to a tent configuration.

20 Claims, 17 Drawing Sheets

(56) References Cited

U.S. PATENT DOCUMENTS

| | | | | |
|---|---|---|---|---|
| 5,769,106 | A * | 6/1998 | Achuff | A41D 15/04 135/95 |
| 5,924,132 | A | 7/1999 | Wigutow | |
| 6,341,379 | B1 | 1/2002 | Kokus | |
| 6,351,851 | B1 * | 3/2002 | Yardan | A41D 3/08 135/95 |
| 7,908,676 | B2 | 3/2011 | Gutshe | |
| 2001/0025384 | A1 * | 10/2001 | Kester | A41D 15/04 2/89 |
| 2006/0283491 | A1 * | 12/2006 | Livacich | E04H 15/001 135/95 |
| 2010/0186137 | A1 * | 7/2010 | Gutshe | A41D 15/04 2/85 |
| 2011/0305505 | A1 * | 12/2011 | Brensinger | A45F 3/00 403/174 |

FOREIGN PATENT DOCUMENTS

| | | | |
|---|---|---|---|
| FR | 2911049 | A1 | 7/2008 |
| GB | 21238 | | 8/1914 |
| RU | 2175516 | C1 | 11/2001 |
| WO | 1987007820 | A1 | 12/1987 |
| WO | 1998030127 | A1 | 7/1998 |

OTHER PUBLICATIONS

Design U.S. Appl. No. 29/595,265, filed Feb. 27, 2017 (13 pages).
U.S. Appl. No. 15/443,472, filed Feb. 27, 2017 (34 pages).
Extended European Search Report dated May 31, 2018, issued in connection with European Patent Application No. 18157236.3 (9 pages).
Adiffbrand posted on Instagram on Feb. 26, 2016 (1 page).
Adiffbrand posted on Instagram on Dec. 16, 2015 (1 page).
Adiffbrand posted on Instagram on Dec. 9, 2015 (1 page).
Adiffbrand posted on Instagram on Nov. 3, 2015 (1 page).
Adiffbrand posted on Instagram on Dec. 11, 2015 (1 page).
Adiffbrand "Finally doing lineup sketches!" posted on Instagram on Nov. 18, 2015 (1 page).
Adiffbrand posted on Instagram on Nov. 18, 2015 (1 page).
Adiffbrand posted on Instagram on Nov. 21, 2015 (1 page).

* cited by examiner

CONVERTIBLE JACKET

CROSS-REFERENCE TO RELATED APPLICATION

This application is a Continuation Application of, and claims priority to, U.S. patent application Ser. No. 15/443,472, filed on Feb. 27, 2017, the entire contents of which are hereby incorporated by reference.

TECHNICAL FIELD

The present disclosure relates to a convertible jacket and, in particular, to a convertible jacket that is convertible between a wearable configuration to a tent configuration.

BACKGROUND

Traditional equipment for protecting people (e.g., refugees, homeless persons, hikers, soldiers, etc.) in the outdoors can include jackets and tents. Usually, these items are separate and jackets are worn while tents are carried. Further, in many instances, tents are unavailable.

SUMMARY

The present disclosure relates to a convertible jacket and, in particular, to a convertible jacket that is convertible between a wearable configuration to a tent configuration. According to some aspects of the present invention the convertible jacket includes a body having one or more panels, sleeve openings, a front zipper, sleeves attached to the body, and an inflatable air channel frame extending along a portion of the body that supports the one or more panels when the air channel frame is inflated.

According to further aspects of the present disclosure, a method for converting a jacket from a wearable configuration to a tent configuration is provided. The method could include the steps of providing a jacket having a body with one or more panels, sleeve openings, and a front zipper, sleeves attached to the body about the sleeve openings, and an inflatable air channel, pulling the sleeves through the sleeve openings to arrange the sleeves on an interior side of the body, closing the front zipper to attach a first edge of the body to a second edge of the body, securing the base to the bottom edge of the body; and inflating the air channel to form a frame to support the one or more panels in a tent configuration.

BRIEF DESCRIPTION OF THE DRAWINGS

To assist those of skill in the art in making and using the disclosed convertible jacket, reference is made to the accompanying figures, wherein.

DESCRIPTION OF EXEMPLARY EMBODIMENTS

It should be understood that the relative terminology used herein, such as "front", "rear," "left," "top," "bottom," "vertical," and "horizontal" is solely for the purposes of clarity and designation and is not intended to limit the present disclosure to any particular position and/or orientation. Accordingly, such relative terminology should not be construed to limit the scope of the present disclosure. In addition, it should be understood that the present disclosure is not limited to any specific dimensions. Thus, any dimensions provided herein are merely for an exemplary purpose and are not intended to limit the present disclosure to any particular dimensions.

Figure 1:
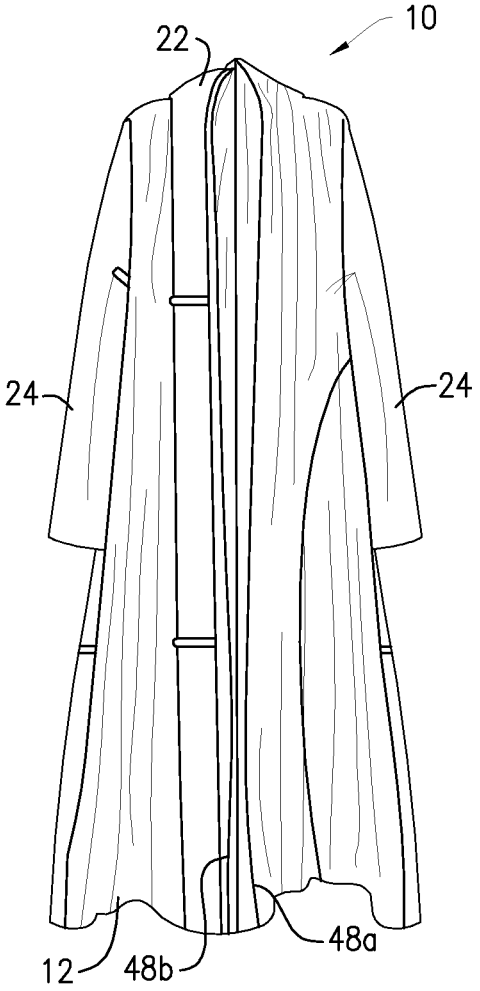
FIG. 1 is a front view of a convertible jacket in a wearable configuration according to the present disclosure.
Figure 2:
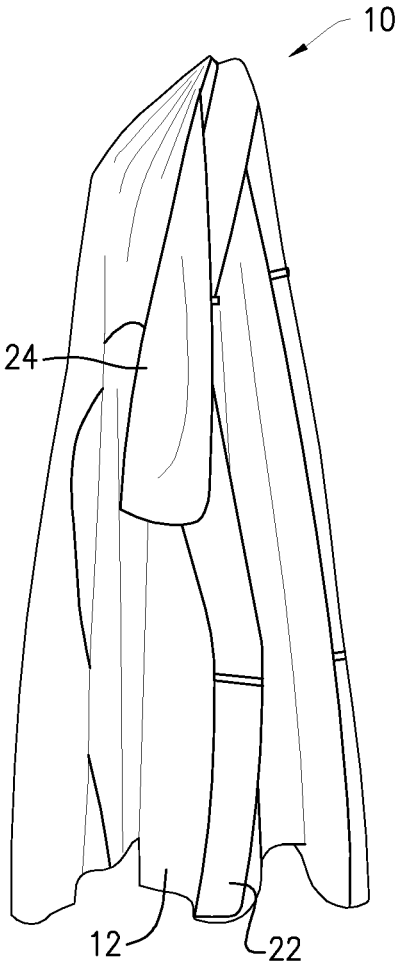
FIG. 2 is a right side view of the convertible jacket of FIG. 1.
Figure 3:
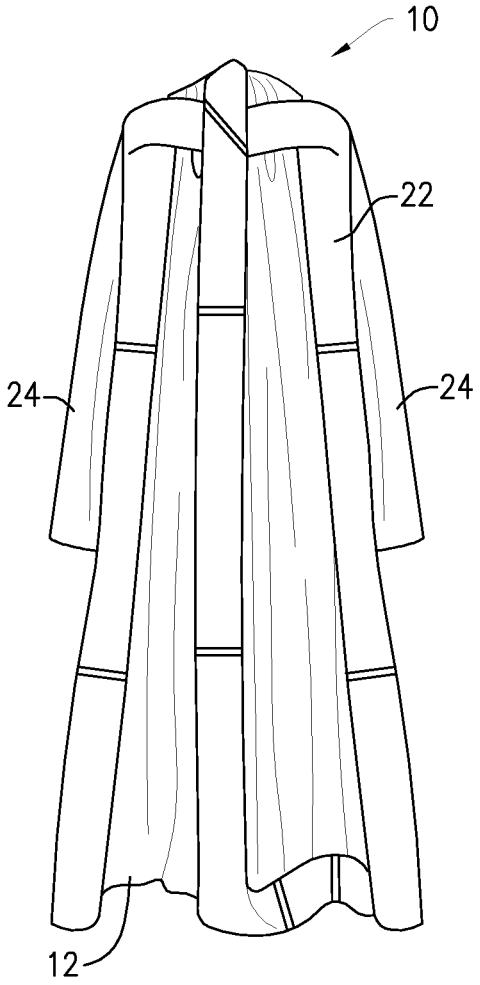
FIG. 3 is a rear view of the convertible jacket of FIG. 1.
Figure 4:
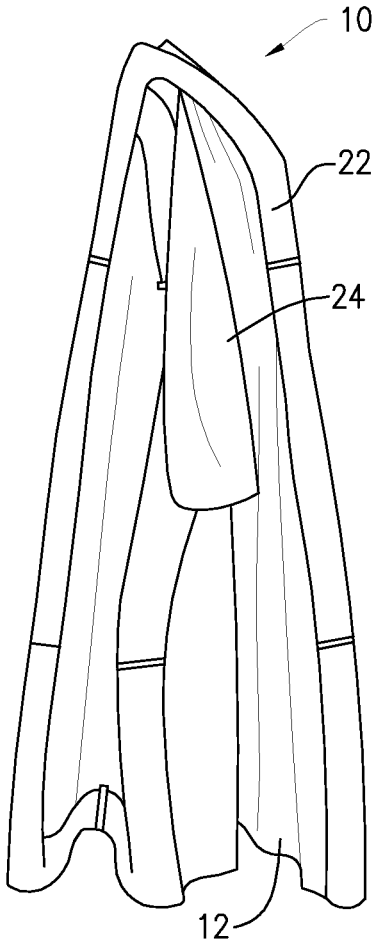
FIG. 4 is a left side view of the convertible jacket of FIG. 1.
Figure 5:
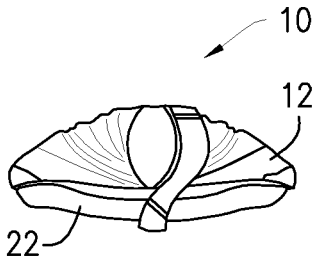
FIG. 5 is a top view of the convertible jacket of FIG. 1.
Figure 6:
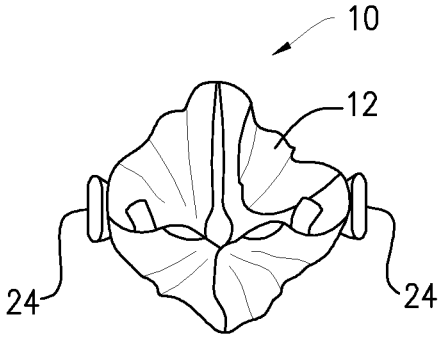
FIG. 6 is a bottom view of the convertible jacket of FIG. 1.

FIGS. 1-6 show a convertible jacket, indicated generally at 10, in a wearable configuration according to the present disclosure, and are referred to herein jointly. More specifically, FIG. 1 is a front view of the convertible jacket 10, FIG. 2 is a right side view of the convertible jacket 10, FIG. 3 is a rear view of the convertible jacket 10, FIG. 4 is a left side view of the convertible jacket 10, FIG. 5 is a top view of the convertible jacket 10, and FIG. 6 is a bottom view of the convertible jacket 10. As shown in FIGS. 1-6, the convertible jacket 10 can include a body 12, an inflatable channel 22, sleeves 24, and a front zipper including a first zipper half 48*a* and a second zipper half 48*b*. Although various zippers are described herein, it is within the scope of the present disclosure that any suitable closure or joining mechanism could be utilized, such as for example, hook and loop material, snaps, magnets, etc.

Figure 8:
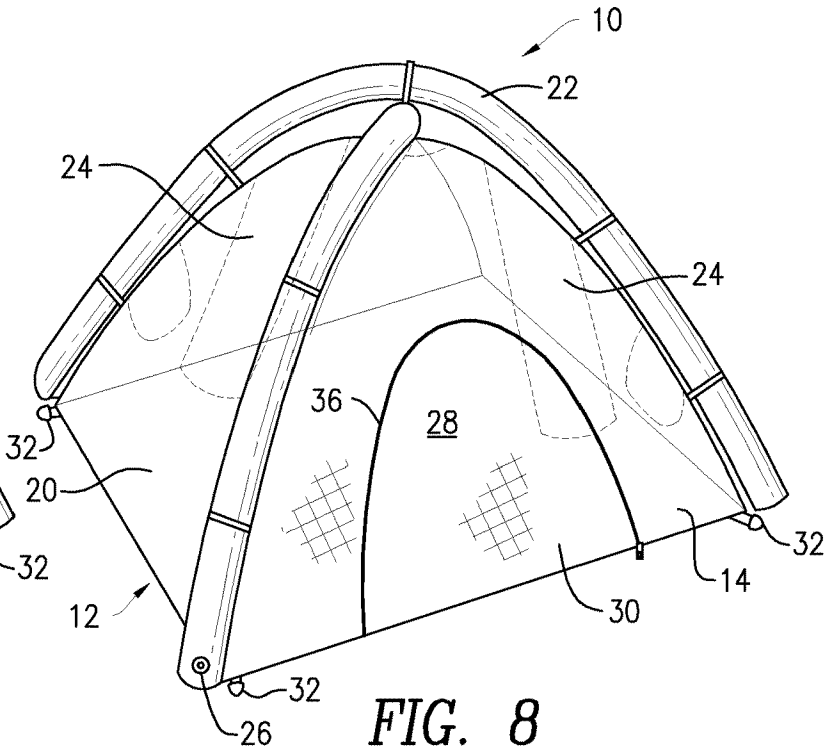
FIG. 8 is a front perspective view of the convertible jacket of FIG. 7 showing internal components.
Figure 7:
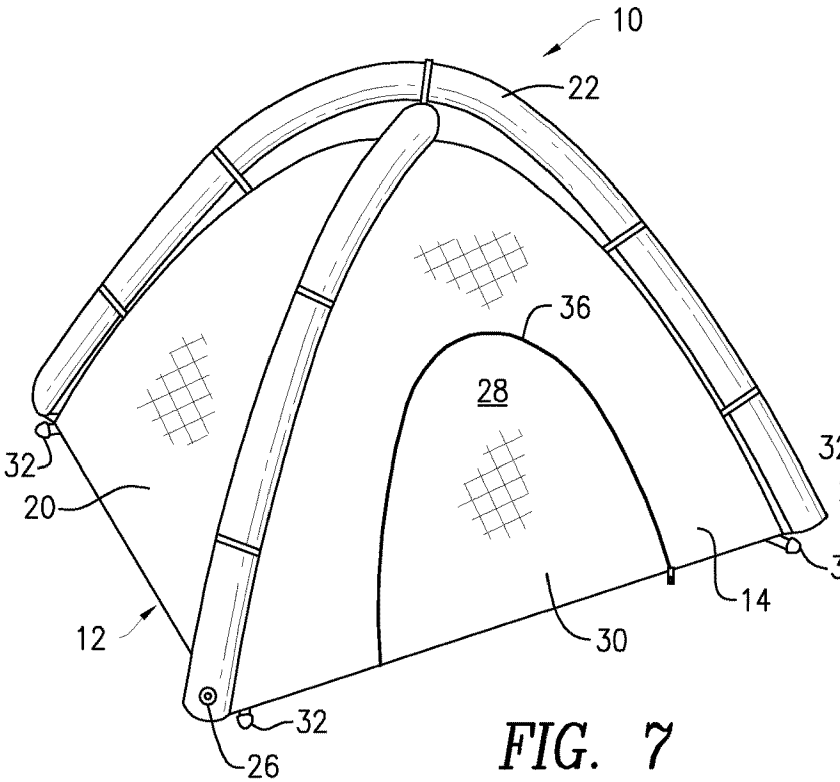
FIG. 7 is a front perspective view of the convertible jacket of FIG. 1 in a tent configuration according to the present disclosure.
Figure 9:
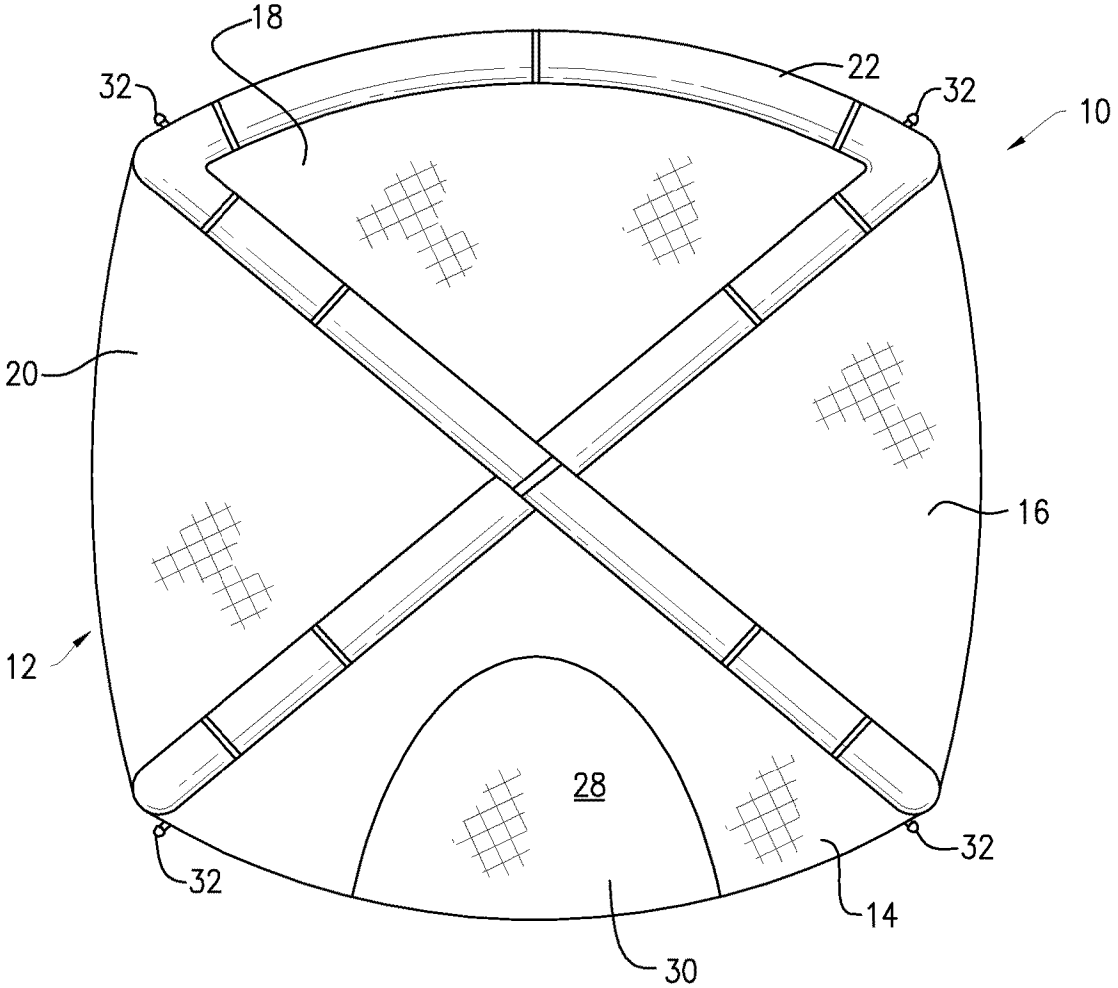
FIG. 9 is a top view of the convertible jacket of FIG. 7.
Figure 10:
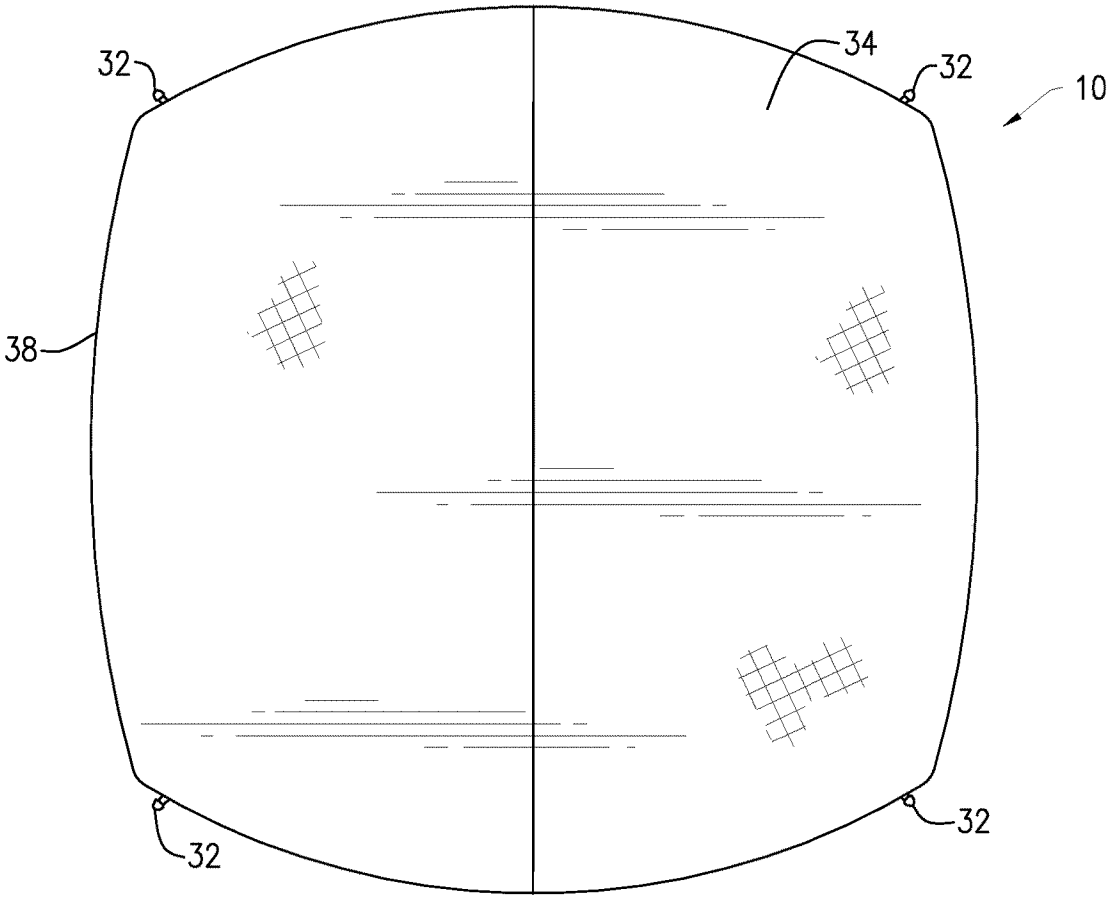
FIG. 10 is a bottom view of the convertible jacket of FIG. 7.
Figure 12:
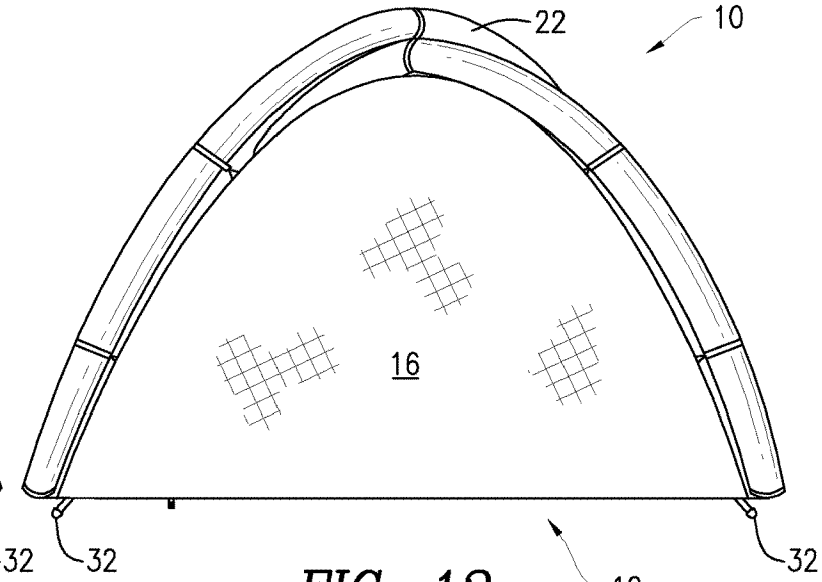
FIG. 12 is a right side view of the convertible jacket of FIG. 7.
Figure 11:
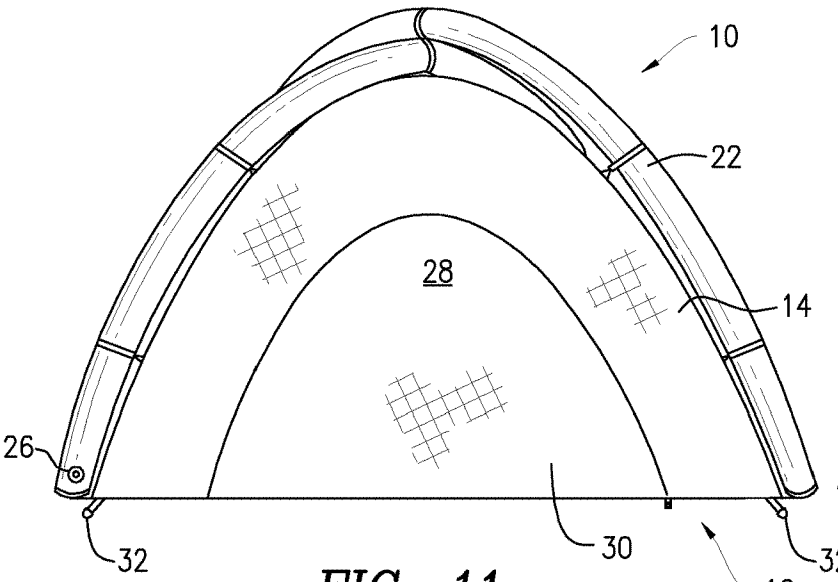
FIG. 11 is a front view of the convertible jacket of FIG. 7.
Figure 14:
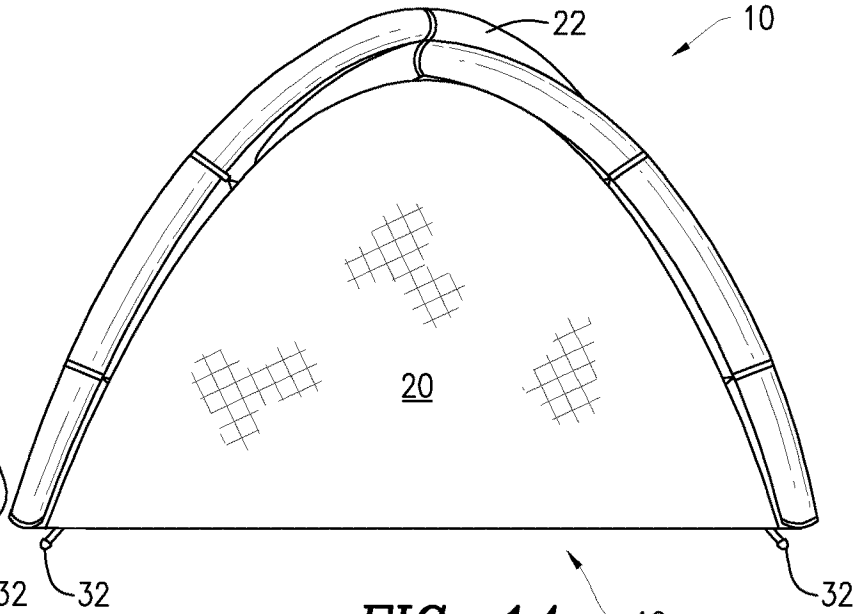
FIG. 14 is a left side view of the convertible jacket of FIG. 7.
Figure 13:
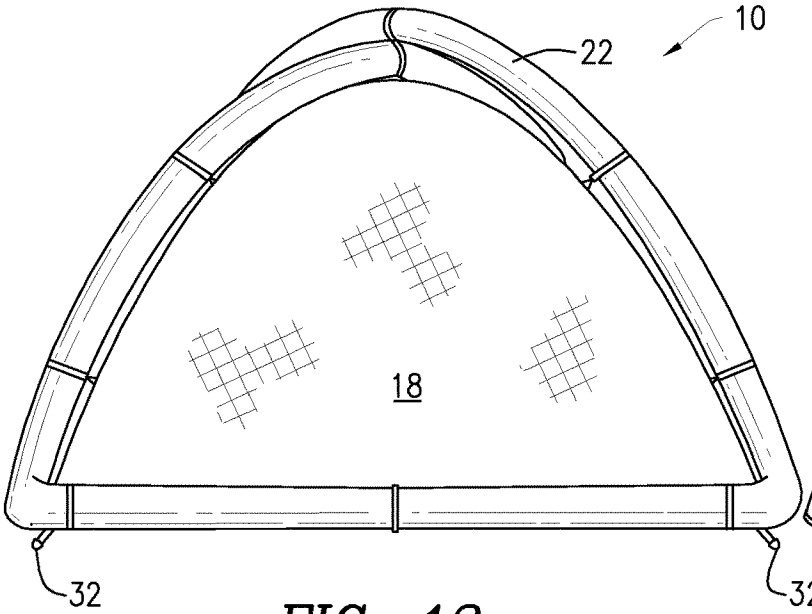
FIG. 13 is a rear view of the convertible jacket of FIG. 7.

FIGS. 7-14 show the convertible jacket 10 (hereinafter also referred to as "tent 10") in a tent configuration according to the present disclosure, and are referred to herein jointly. More specifically, FIG. 7 is a front perspective view of the convertible jacket 10, FIG. 8 is a front perspective view of the convertible jacket 10, FIG. 9 is a top view of the convertible jacket 10, FIG. 10 is a bottom view of the convertible jacket 10, FIG. 11 is a front view of the convertible jacket 10, FIG. 12 is a right side view of the convertible jacket 10, FIG. 13 is a rear view of the convertible jacket 10, and FIG. 14 is a left side view of the convertible jacket 10. As shown in FIGS. 7-14, the body 12 of the convertible jacket 10 can include a first panel 14, a second panel 16, a third panel 18, and a fourth panel 20. When the convertible jacket 10 is in the tent configuration, the first panel 14, the second panel 16, the third panel 18, the fourth panel 20, and a base 34 define an enclosed interior space for providing shelter to one or more occupants. As shown in FIG. 8, when the convertible jacket 10 is provided in the tent configuration, the sleeves 24 are pulled within the interior space of the convertible jacket 10 and the exterior is closed off by a zipper or any other suitable closure or joining mechanism (e.g., hook and loop material, snaps, magnets, etc.). Further, the first panel 14 could be provided with an opening 28 for providing ingress and egress into and out of the interior space, and a flap 30 could be provided that is sized and shaped for closing the opening 28. The flap 30 could be removably affixed to the first panel 14 by way of a zipper 36 or any other suitably durable fastening means.

As shown in FIG. 9, an air channel 22 could be provided a single unitary structure that provides support (e.g., forming a frame) for the convertible jacket 10, when provided in the tent configuration. However, according to some aspects of the present disclosure, a plurality of air channels 22 could be provided (not shown). The air channel 22 could be configured to traverse a first edge where panel 14 is joined to panel 20, a second edge where panel 16 is joined to panel 18, a bottom edge of panel 18, a third edge where panel 18 is joined to panel 20, and a fourth edge where panel 14 is joined to panel 16.

As shown in FIG. 10, a base 34 could be provided having a perimeter 38 that could be coupled to bottom edges of first panel 14, second panel 16, third panel 18, and fourth panel 20. The base 34 could be either fixedly or removably secured to the body 12. Anchoring means 32 could also be provided for securing the convertible jacket 10 to the ground when in the tent configuration. For example, anchoring means 32 could include rings or flaps for receiving tenting stakes (not shown) therethrough. The stakes could then be forced into the ground, thereby securing the convertible jacked 10 in place.

Figure 18A:
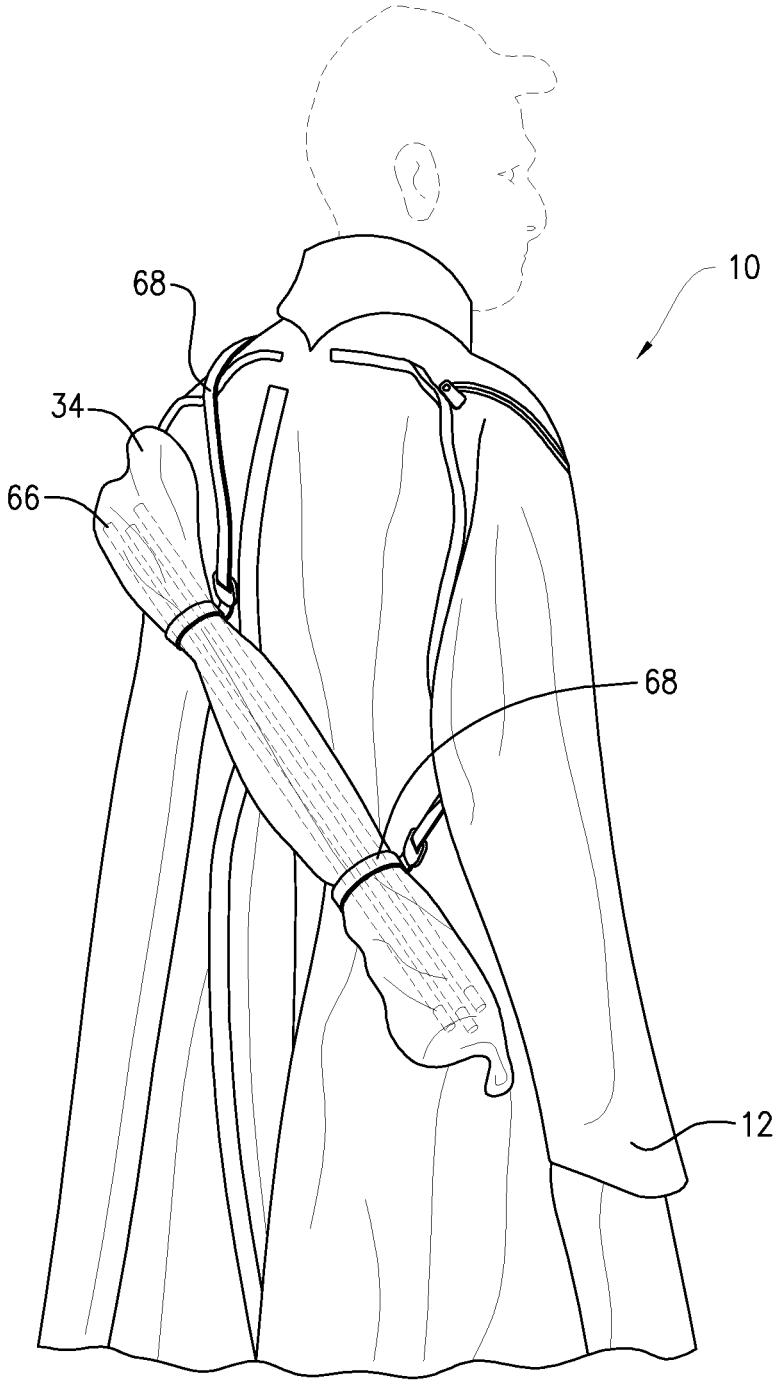
FIGS. 18A and 18B are partial perspective views illustrating another aspect of the convertible jacket of the present disclosure.
Figure 18B:
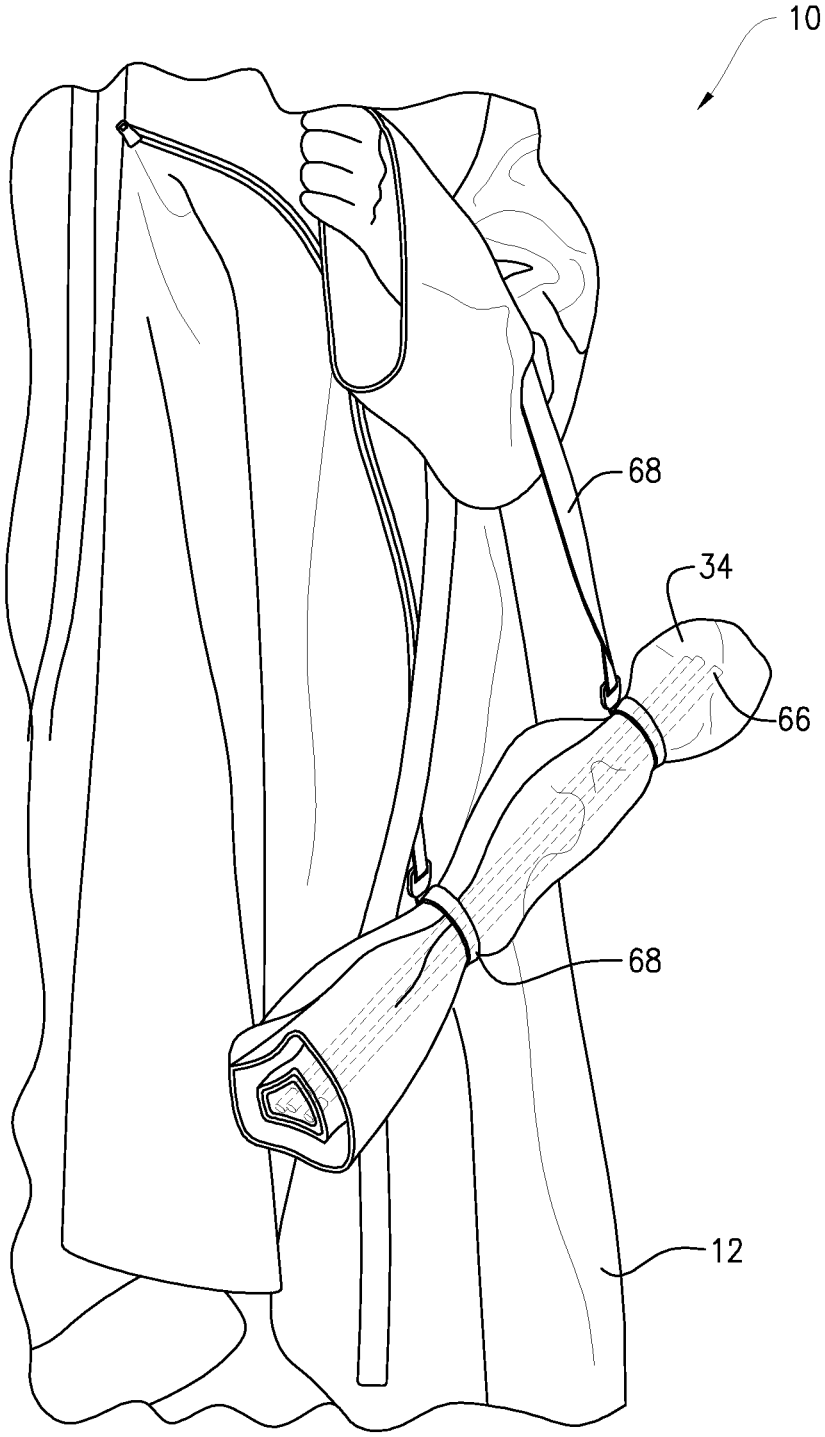

The convertible jacket 10 could be provided with one or more valves 26 for inflating and/or deflating the air channel 22. An air pump 62 (see FIG. 25) could be attached to the one or more valves for inflation of the air channel 22, or one could manually blow air into the air channel 22. When inflated, the air channel 22 could provide support for, of form a frame for, the convertible jacket 10 in the tent configuration. According to some aspects of the present disclosure, the convertible jacket 10 could also be provided with tent poles 66 (see FIGS. 18A and 18B) in addition to, or in place of, the inflatable air channel 22. For example, inflatable air channel 22 could be sized and shaped for receiving tent poles 66. Additionally, as shown in FIGS. 18A and 18B, tent poles 66 could be rolled into tent base 34 for storage and transportation. Straps 68 could also be provided for securing the tent poles 66 within the tent base 34, thereby forming a rolled sack for hands-free transportation.

Figures 15A, 15B, 15C:
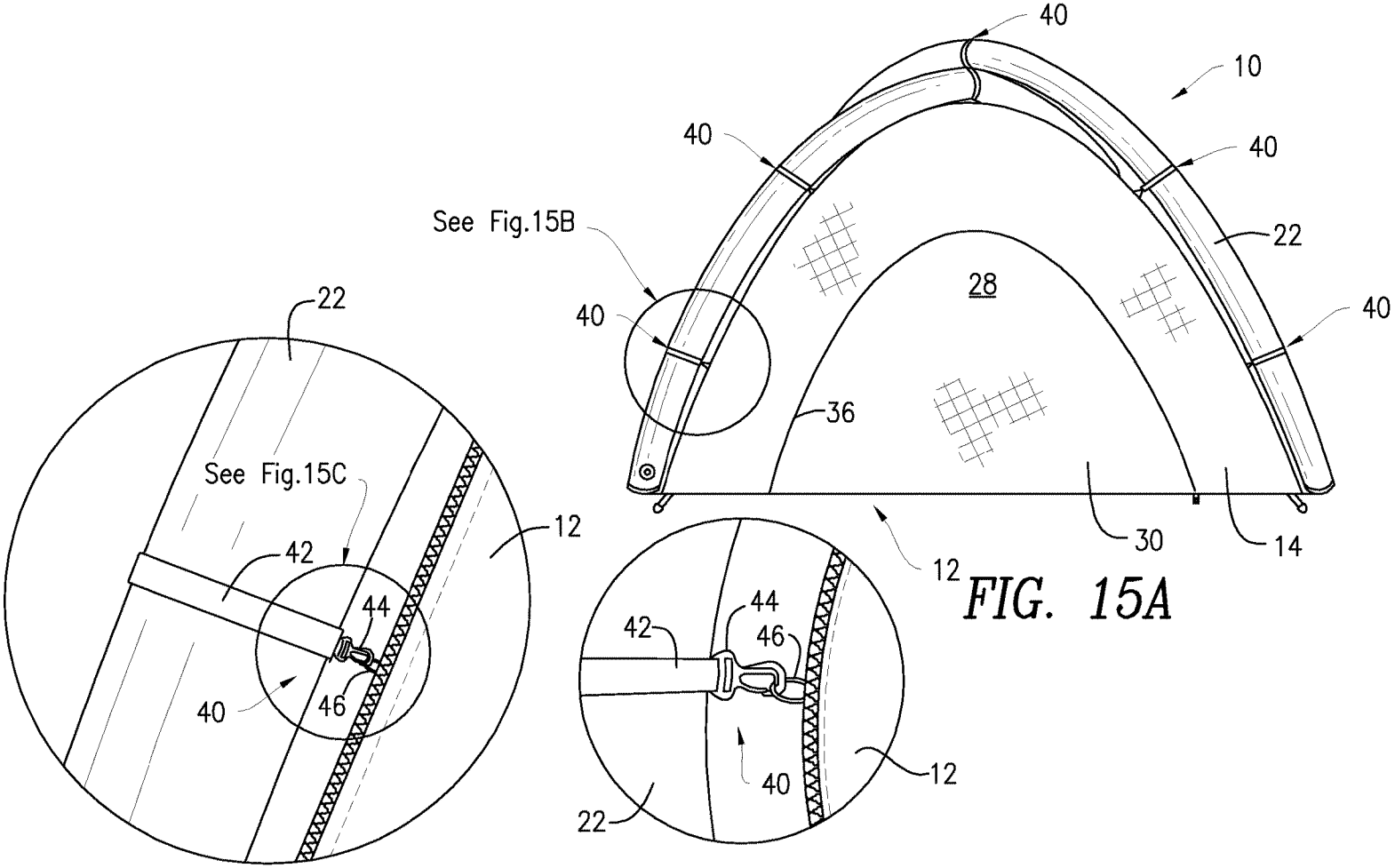
FIGS. 15A-C are detailed views of the convertible jacket of FIG. 7 showing an exemplary means for attaching an air channel to a body of the convertible jacket according to the present disclosure.

FIGS. 15A-C are detailed views of the convertible jacket 10 in the tent configuration, showing an exemplary attachment of the air channel 22 to the body 12 of the convertible jacket 10 according to the present disclosure. As described above, the air channel 22 could be configured to traverse a first edge where panel 14 is joined to panel 20, a second edge where panel 16 is joined to panel 18, a bottom edge of panel 18, a third edge where panel 18 is joined to panel 20, and a fourth edge where panel 14 is joined to panel 16. Air channel 22 could be secured to the convertible jacket 10 by way of a fastening system 40, which could include a strap 42 disposed around air channel 22, a clip 44 secured to the strap 42, and a ring 46 secured to the body 12. The clip 44 could be clipped to the ring 46 and multiple fastening systems 40 could be disposed along the length of the air channel 22, thereby securing the air channel 22 in a desired location. The air channel 22 could also be formed integrally with the jacket, attached by a hook and loop fastener system, or otherwise fixedly or removably attached.

Figure 16:
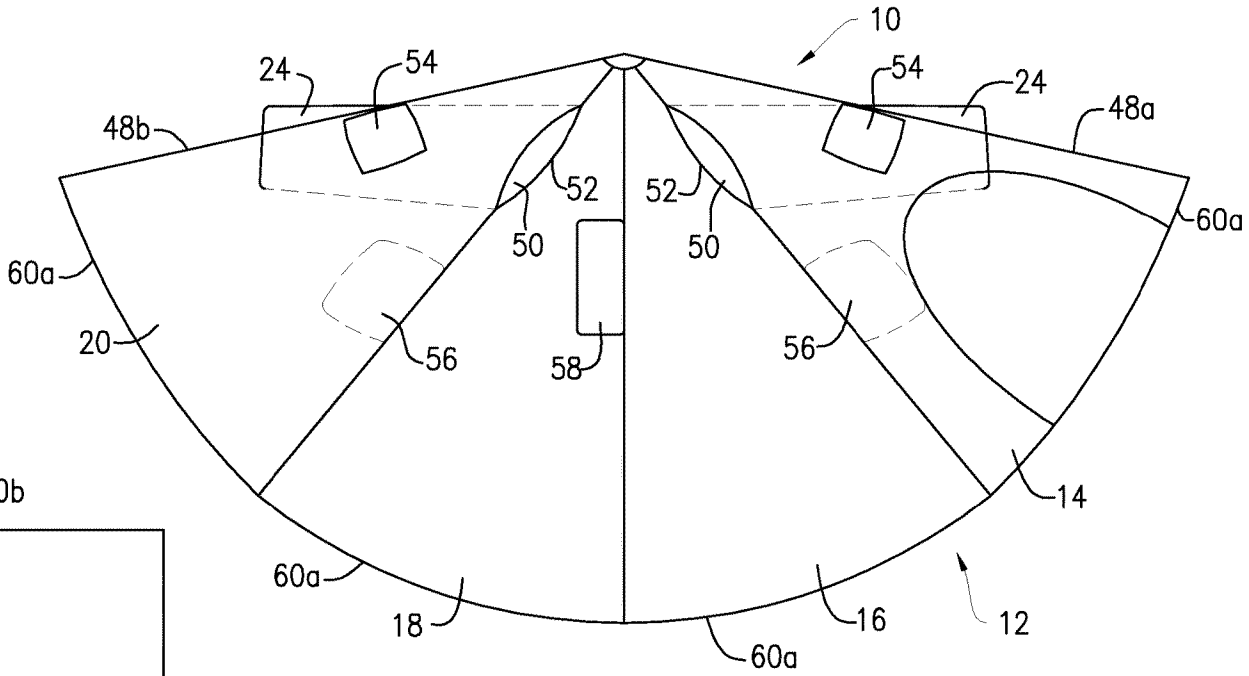
FIG. 16 is a top view of the convertible jacket of FIG. 1 in a spread-open configuration according to the present disclosure.
Figure 17:
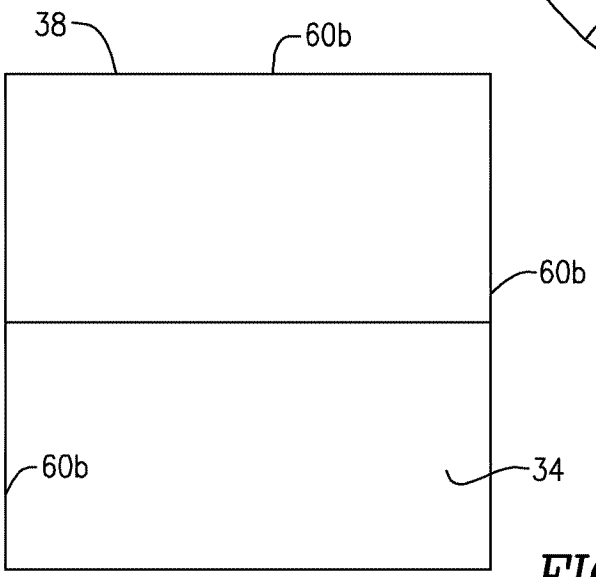
FIG. 17 is a top view of a base of the convertible jacket of FIG. 7 according to the present disclosure.

FIG. 16 is a top view of the convertible jacket 10 in an open configuration and FIG. 17 is a top view of the tent base 34 of the convertible jacket 10 detached from the body 12. As shown in FIG. 16, and described above, the body 12 of the convertible jack 10 includes first panel 14, second panel 16, third panel 18, and fourth panel 20. Sleeve openings 50 are provided between panel 14 and panel 16 and between panel 18 and panel 20. Accordingly, sleeves 24 are attached to the body 12 about a perimeter of the sleeve openings 50, which allow the arms of an individual to pass through from an interior of the body 12 into the sleeves 24 when the multi-use jacket 10 is in the wearable configuration. Zippers 52 could be disposed around the perimeter of the sleeve openings 50 for closing sleeve openings 50 when the multi-use jacket 10 is provided in the tent configuration. Further, a first zipper half 48*a* could be disposed on an edge of panel 14 opposite the edge of panel 14 that is joined to panel 16 and a second zipper half 48*b* could be disposed on an edge of panel 20 opposite the edge of panel 20 that is joined to panel 18. According so some aspects of the invention, first zipper half 48*a* and second zipper half 48*b* can also function as a front zipper for the convertible jacket 10 when provided in the wearable configuration (see, e.g., FIG. 1). Additionally, as shown in FIG. 16, bottom edges of panels 14-20 could be provided with first zipper halves 60*a* and as shown in FIG. 17, the base 34 could be provided with second zipper halves 60*b*. First zipper half 48*a* and second zipper half 48*b* could be mated when the convertible jacket 10 is converted from the wearable configuration into the tent configuration as described herein in connection with FIGS. 19-23B. Similarly, first zipper halves 60*a* and second zipper halves 60*b* could be mated when the convertible jacket 10 is converted from the wearable configuration into the tent configuration as described herein in connection with FIGS. 19-23B.

The convertible jacket 10 could also be provided with internal pockets 54, exterior hand pockets 56, and a back patch pocket 58. As shown in FIG. 16, the internal pockets (e.g., breast pockets) 54 could be disposed on an internal side of the body 12 on either side of zipper 48, thereby providing additional storage compartments. The hand pockets could be disposed on an external side of the body 12 on either side of zipper 48 and could be closed off by a zipper or any other suitable closure or joining mechanism (e.g., hook and loop material, snaps, magnets, etc.). According to some aspects of the present disclosure, the tent base 34 could be folded and stored in back patch pocket 58 when the convertible jacket 10 is in the wearable configuration.

Figures 19, 20, 21:
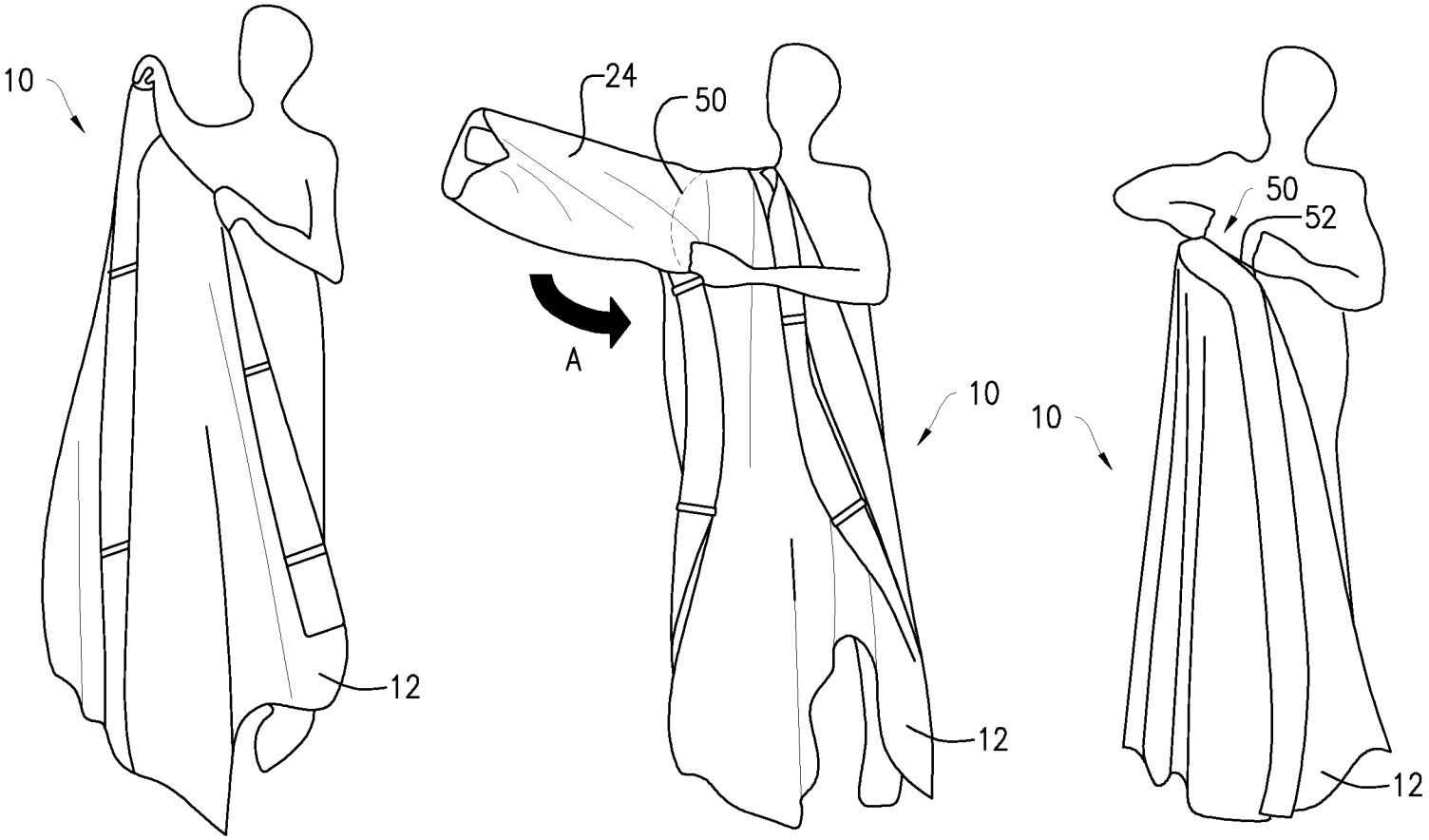
FIGS. 19-23B illustrate steps for converting the convertible jacket of FIG. 1 from a wearable configuration to an inflatable configuration.
Figure 22B:
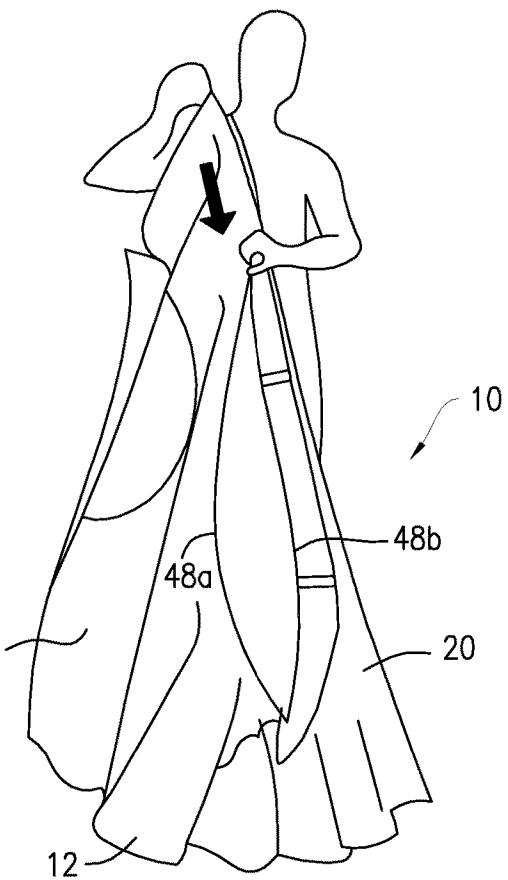
Figure 22A:
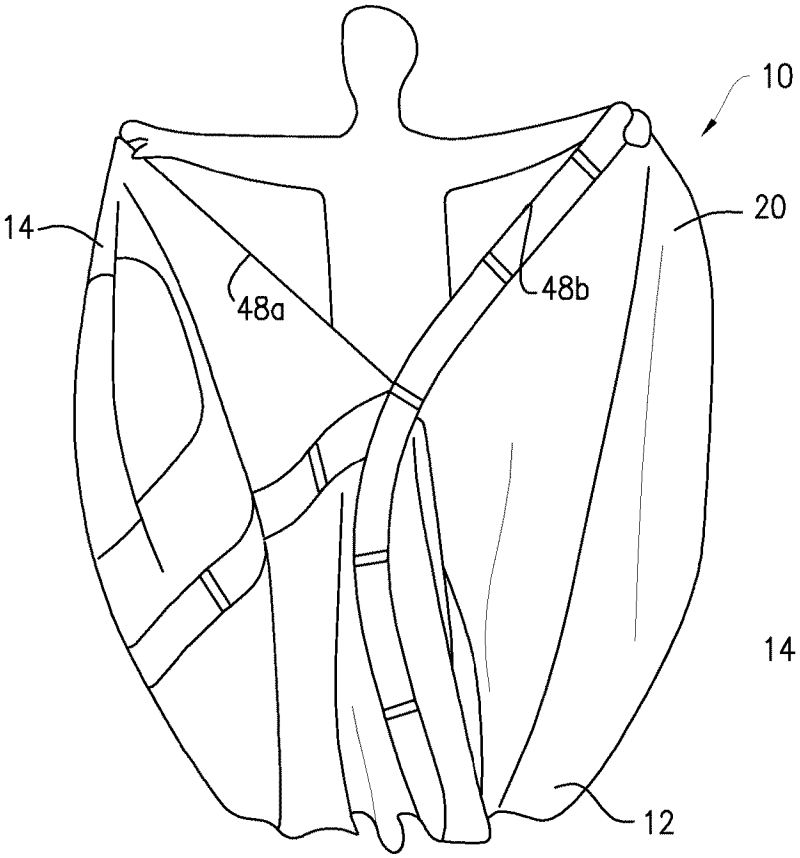
Figure 23B:
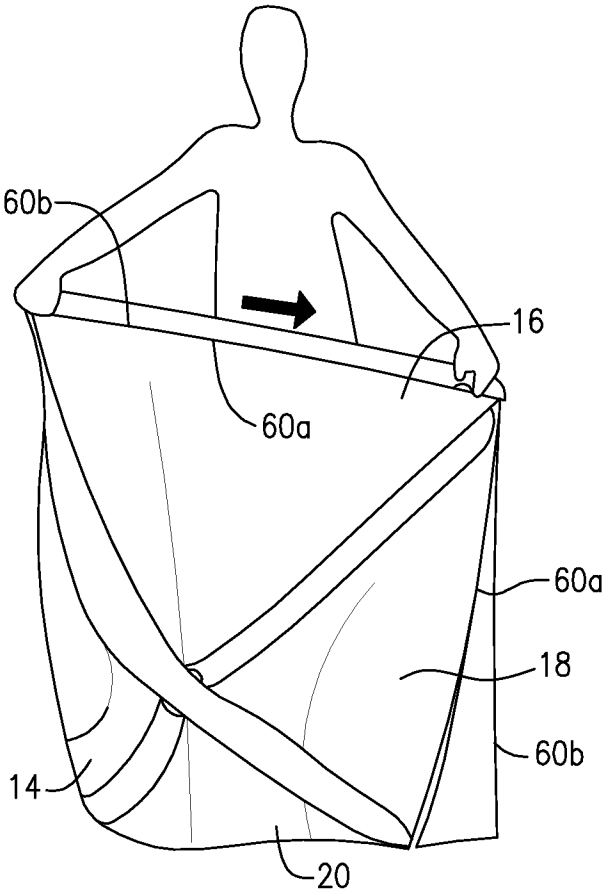
Figure 23A:
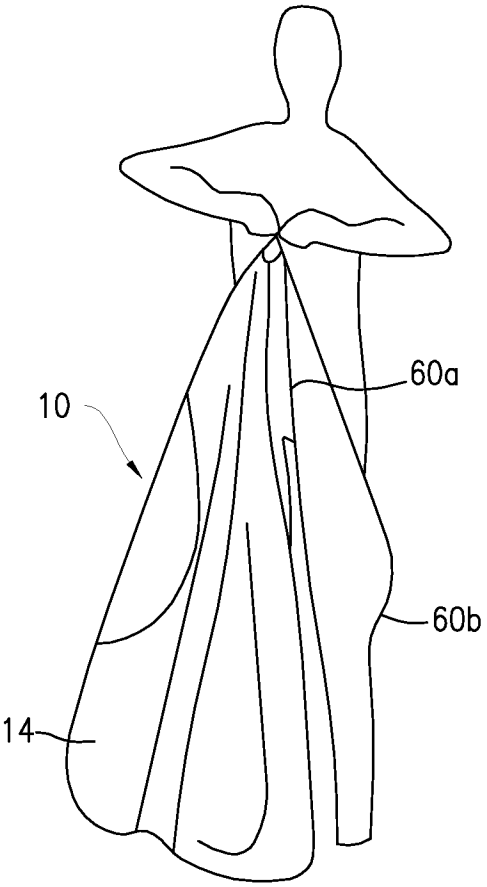

FIGS. 19-23B illustrate a method for converting the convertible jacket 10 from the wearable configuration into a tent configuration. As shown in FIG. 19, a wearer first removes the convertible jacket 10. As shown in FIG. 20, sleeves 24 are pulled through sleeve openings 50 from an exterior to the interior of the convertible jacket 10, as illustrated by arrow A. As shown in FIG. 21, once the sleeves 24 have been positioned within the interior of the convertible jacket 10, zippers 52 disposed around the sleeve openings 50 could then be closed (if provided), thereby providing a continuous outer surface of the body 12 for shielding an occupant from the elements, for example, wind, rain, snow, hail, etc. As shown in FIGS. 22A and 22B, first zipper half 48*a* and second zipper half 48*b* are then mated, thereby joining first panel 14 to fourth panel 20 and forming a continuous body 12 for the convertible jacket 10 in the tent configuration (see, e.g., FIG. 7). As shown in FIGS. 23A and 23B, the tent base 34 can then be attached to the body 12. For example, as described above, first zipper halves 60*a* provided on bottom edges of panels 14-20 could be mated to second zipper halves 60*b* provided on the exterior perimeter 38 of the tent base 34.

Figure 25:
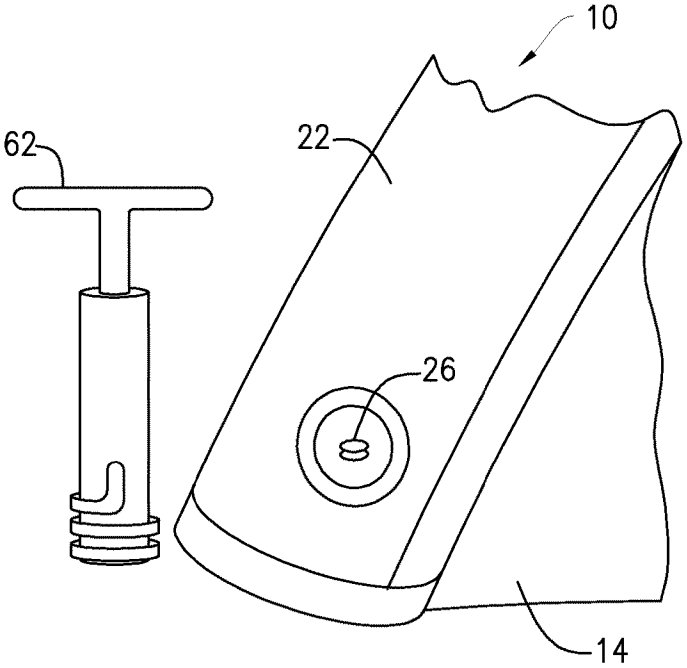
FIG. 25 shows a valve and an air pump according to some aspects of the present disclosure.
Figure 24:
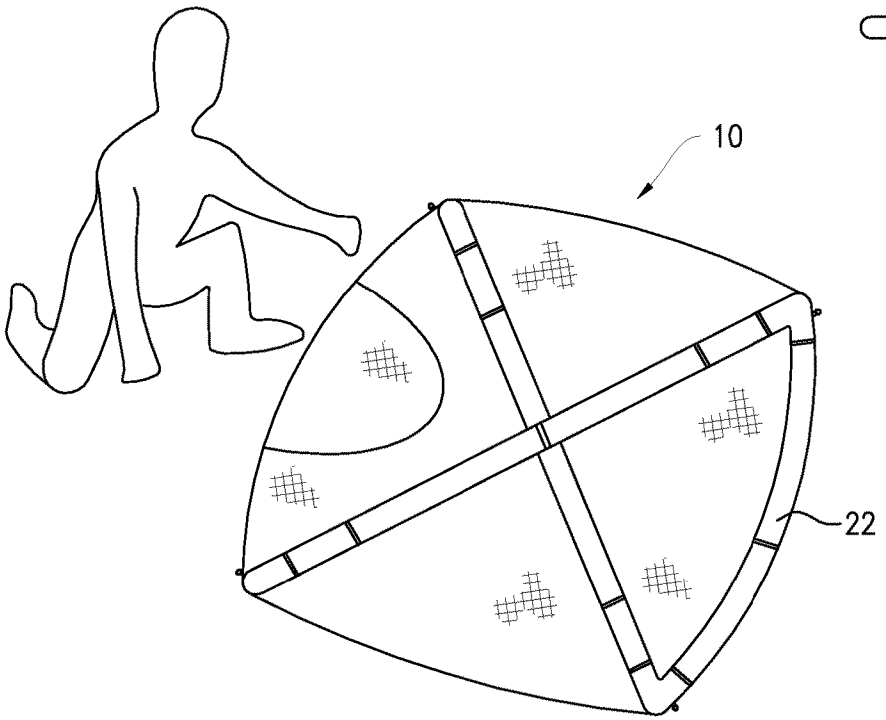
FIG. 24 is a top view of the convertible jacket of FIG. 1 in an inflatable configuration according to the present disclosure.
Figure 26:
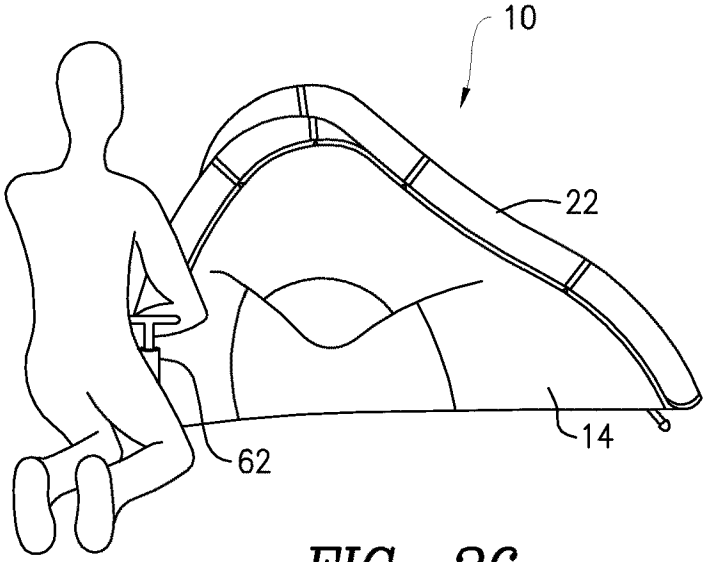
FIG. 26 illustrates the convertible jacket of FIG. 1 in a partially-inflated configuration.

After converting the convertible jacket 10 into a tent configuration (see FIG. 24) as described in connection with FIGS. 19-23B, the air channel 22 of the convertible jacket 10 can be inflated. As shown in FIGS. 25 and 26, an air pump (e.g., motorized, hand-held, manual, etc.) 62 can be used to inflate the air channel 22. Although the air pump 62 could be used to inflate the air channel 22, according to some aspects of the present disclosure, valve 26 could be configured to allow a user to manually inflate the air channel, for example, by blowing into the valve 26.

Figure 27:
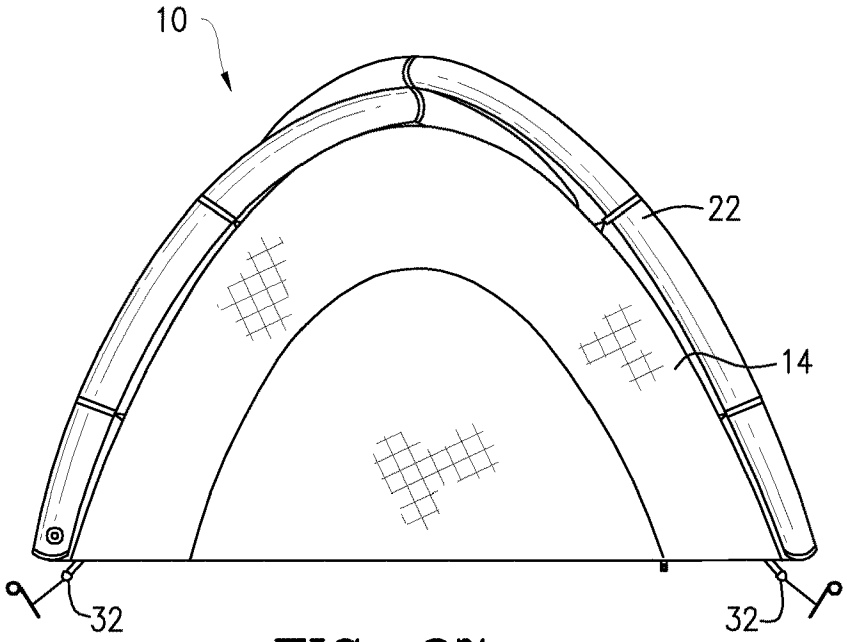
FIG. 27 illustrates the convertible jacket of FIG. 1 in a fully-inflated configuration.

FIG. 27 illustrates the convertible jacket 10 in a fully-inflated configuration. Once the air channel 22 is fully inflated, the convertible jacket 10 could be secured to the ground using anchoring means 32 and tenting stakes 64. For example, as described above, anchoring means 32 could receive tenting stakes 64 therethrough and the tenting stakes 64 could then be forced into the ground, thereby securing the convertible jacked 10 in place.

While exemplary embodiments have been described herein, it is expressly noted that these embodiments should not be construed as limiting, but rather that additions and modifications to what is expressly described herein also are included within the scope of the invention. Moreover, it is to be understood that the features of the various embodiments described herein are not mutually exclusive and can exist in various combinations and permutations, even if such combinations or permutations are not made express herein, without departing from the spirit and scope of the invention.

What is claimed is:

1. A jacket convertible to a tent, comprising:

a body having one or more panels, sleeve openings, and a front zipper;

sleeves attached to the body about the sleeve openings;

sleeve zippers disposed about perimeters of the sleeve openings;

one or more tent poles;

one or more channels extending along a portion of the body, the one or more channels sized and shaped for receiving the one or more tent poles;

the one or more tent poles disposed within the one or more channels;

the sleeve zippers being positionable in a first open position for use as a jacket, and a second closed position for use as a tent; and the tent having a bottom perimeter, the tent supported by the one or more tent poles in the one or more channels.

2. The jacket of claim 1, wherein the one or more channels further comprise a first portion extending diagonally from a first corner to a first opposite corner and a second portion extending diagonally from a second corner to a second opposite corner.

3. The jacket of claim 1, further comprising a fastening system for removably securing the one or more channels to the body.

4. The jacket of claim 1, further comprising a base attachable to a bottom edge of the jacket body.

5. The jacket of claim 1, wherein the body includes second, third, and fourth panels.

6. The jacket of claim 1, wherein the sleeve zippers are closeable when the sleeves are arranged on an interior side of the body.

7. The jacket of claim 6, wherein the sleeve zippers are not closeable when the sleeves are arranged on an exterior side of the body.

8. The jacket of claim 1, wherein the one or more panels include an opening for ingress and egress and a flap removably affixed to the one or more panels within the opening.

9. The jacket of claim 3, wherein the fastening system for removably securing the one or more channels to the body includes a strap disposed around the channel, a clip attached to the strap, and a ring attached to the body.

10. The jacket of claim 4, further comprising a means for securing the base to the bottom edge of the body including first zipper halves disposed on a bottom edge of the one or more panels and second zipper halves disposed on a periphery of the base.

11. The jacket of claim 1, further comprising anchoring means and tenting stakes.

12. A jacket convertible to a tent, comprising:

a body having one or more panels, sleeve openings, and a front zipper;

sleeves attached to the body about the sleeve openings;

sleeve zippers disposed about perimeters of the sleeve openings;

a frame including one or more tent poles;

a plurality of straps extending along a portion of the body for securing the frame to the body;

the sleeve zippers being positionable in a first open position for use as a jacket, and a second closed position for use as a tent; and the tent having a bottom perimeter, the tent supported by the frame and the plurality of straps.

13. The jacket of claim 12, wherein the straps comprising the plurality of straps are positioned at intervals along a line extending diagonally from a first corner to a first opposite corner and a second corner to a second opposite corner.

14. The jacket of claim 12, further comprising a base attachable to a bottom edge of the jacket body.

15. The jacket of claim 12, wherein the body includes second, third, and fourth panels.

16. The jacket of claim 12, wherein the sleeve zippers are closeable when the sleeves are arranged on an interior side of the body.

17. The jacket of claim 16, wherein the sleeve zippers are not closeable when the sleeves are arranged on an exterior side of the body.

18. The jacket of claim 12, wherein the one or more panels include an opening for ingress and egress and a flap removably affixed to the one or more panels within the opening.

19. The jacket of claim 14, further comprising a means for securing the base to the bottom edge of the body including first zipper halves disposed on a bottom edge of the one or more panels and second zipper halves disposed on a periphery of the base.

20. The jacket of claim 12, further comprising anchoring means and tenting stakes.

* * * * *